US010600387B2

(12) United States Patent
Seong et al.

(10) Patent No.: US 10,600,387 B2
(45) Date of Patent: Mar. 24, 2020

(54) DISPLAY APPARATUS AND METHOD FOR DRIVING A BACKLIGHT TO PREVENT OR REDUCE GRADATION OVERCOMPENSATION

(71) Applicant: SAMSUNG ELECTRONICS CO., LTD., Suwon-si, Gyeonggi-do (KR)

(72) Inventors: Hwa-seok Seong, Suwon-si (KR); Young-hun Jo, Suwon-si (KR); Gang-mo Koo, Suwon-si (KR); Sang-su Lee, Hwaseong-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/840,352

(22) Filed: Dec. 13, 2017

(65) Prior Publication Data

US 2018/0182356 A1 Jun. 28, 2018

(30) Foreign Application Priority Data

Dec. 23, 2016 (KR) ..... 10-2016-0178449

(51) Int. Cl.

| | |
|---|---|
| ***G09G 5/10*** | (2006.01) |
| ***G09G 5/00*** | (2006.01) |
| ***G09G 3/34*** | (2006.01) |

(52) U.S. Cl.

CPC ..... *G09G 5/10* (2013.01); *G09G 3/3426* (2013.01); *G09G 5/003* (2013.01);

(Continued)

(58) Field of Classification Search

CPC .. G09G 5/003; G09G 5/10; G09G 2300/0452; G09G 2320/0285;

(Continued)

(56) References Cited

U.S. PATENT DOCUMENTS

| | | | |
|---|---|---|---|
| 8,144,173 | B2 | 3/2012 | Baba et al. |
| 8,305,339 | B2 | 11/2012 | Baba et al. |

(Continued)

FOREIGN PATENT DOCUMENTS

| | | |
|---|---|---|
| JP | 5113940 | 1/2013 |
| JP | 5855619 | 2/2016 |

(Continued)

*Primary Examiner* — Amit Chatly
*Assistant Examiner* — Nelson Lam
(74) *Attorney, Agent, or Firm* — Nixon & Vanderhye P.C.

(57) ABSTRACT

A display apparatus and a method for controlling the same are provided. The method for controlling the display apparatus according to the present disclosure includes receiving an image; distinguishing the image into a plurality of blocks to detect a maximum pixel value each of the plurality of blocks; determining a target diffuser value usable for compensating for a duty of a backlight based on the detected maximum pixel value for each block; and driving the backlight for each of the plurality of blocks based on a backlight duty value compensated based on the target diffuser value. Therefore, the display apparatus according to the present disclosure may address a problem that gradation overcompensation occurs in a region of a certain block, when the backlight is driven in a unit of the plurality of blocks, using a local dimming mode.

15 Claims, 10 Drawing Sheets

(52) U.S. Cl.
CPC ..... *G09G 2300/0452* (2013.01); *G09G 2320/0276* (2013.01); *G09G 2320/0285* (2013.01); *G09G 2320/066* (2013.01); *G09G 2320/0626* (2013.01); *G09G 2320/0646* (2013.01); *G09G 2360/16* (2013.01)

(58) Field of Classification Search
CPC ..... G09G 2320/0646; G09G 3/3406; G09G 3/3413; G09G 3/342; G09G 3/3426; G09G 3/36; G09G 3/364; G09G 3/3644
USPC ..... 345/87–104
See application file for complete search history.

(56) References Cited

U.S. PATENT DOCUMENTS 8,710,768 B2 4/2014 Rogers et al.
9,087,485 B2 7/2015 Ahn et al.
9,107,268 B2 8/2015 Kubo
2009/0267926 A1* 10/2009 Seo ..... G09G 3/3426 345/204
2010/0110111 A1* 5/2010 Kim ..... G09G 3/3426 345/690
2011/0122057 A1* 5/2011 Kim ..... G09G 3/3426 345/102
2011/0141077 A1* 6/2011 Cho ..... G09G 3/3426 345/207
2011/0141090 A1* 6/2011 Hong ..... G09G 3/3426 345/211
2012/0056907 A1* 3/2012 Lee ..... G09G 3/3426 345/690
2014/0071186 A1* 3/2014 Kang ..... G09G 3/342 345/690
2014/0225935 A1* 8/2014 Lee ..... G09G 3/3426 345/690
2018/0005599 A1* 1/2018 Chen ..... G09G 3/3406

FOREIGN PATENT DOCUMENTS

KR 10-1148394 5/2012
KR 10-2013-0052298 5/2013
KR 10-1341016 1/2014

* cited by examiner

DISPLAY APPARATUS AND METHOD FOR DRIVING A BACKLIGHT TO PREVENT OR REDUCE GRADATION OVERCOMPENSATION

CROSS-REFERENCE TO RELATED APPLICATION

This application is based on and claims priority under 35 U.S.C. § 119 to Korean Patent Application No. 10-2016-0178449, filed on Dec. 23, 2016, in the Korean Intellectual Property Office, the disclosure of which is incorporated by reference herein in its entirety.

BACKGROUND

Field

The present disclosure relates generally to a display apparatus and a method for controlling the same, and for example, to a display apparatus for compensating for brightness of pixels and a method for controlling the same.

Description of Related Art

In order to prevent a phenomenon that a contrast ratio of an image is reduced, a local dimming driving method is recently used in which a backlight is controlled for each position and is driven.

In such a local dimming driving method, the backlight is distinguished into a plurality of blocks, and the backlight for each of the plurality of blocks is controlled according to a contrast for each region of a display corresponding to the plurality of distinguished blocks.

For example, the backlight is controlled to emit at brightness of low luminance in a block corresponding to a region on which a black image is displayed, and the backlight is controlled to emit light at brightness of high luminance in a block corresponding to a region on which a white image is displayed.

Meanwhile, in a case in which pixels of some of an entire region of a certain block among the plurality of blocks is higher than pixels of the remaining regions, since the conventional local dimming method drives the backlight in consideration of all pixels included in the corresponding block without considering the pixels of some regions, there is a problem in that gradation overcompensation occurs in some regions having the high pixels.

SUMMARY

Example embodiments of the present disclosure address the above disadvantages and other disadvantages not described above.

The present disclosure provides a display apparatus and a method for controlling the same that addresses a problem in that gradation overcompensation occurs in a certain block, when a backlight is driven in units of a plurality of blocks using a local dimming method.

According to an example aspect of the present disclosure, a method for controlling a display apparatus according to the present disclosure includes receiving an image; distinguishing the image in a unit of a plurality of blocks to detect a maximum pixel value of each of the plurality of blocks; determining a target diffuser usable to compensate for a duty of a backlight based on the detected maximum pixel value for each block; and driving the backlight for each of the plurality of blocks based on a backlight duty value compensated for based on the target diffuser.

The determining of the target diffuser may include calculating (determining) a maximum pixel compensation ratio for each block based on the maximum pixel value; and determining the target diffuser for each block with reference to a pixel compensation table representing an association between a pixel compensation ratio and a backlight diffuser.

The maximum pixel compensation ratio for each block may be a ratio of a difference between the maximum pixel value that the pixel for each block has and the detected maximum pixel value for each block, and the detected maximum pixel value for each block.

The determining of the target diffuser for each block may include obtaining the pixel compensation ratio for each block corresponding to a predetermined backlight initial diffuser with reference to the pixel compensation table; calculating (determining) an error between the pixel compensation ratio for each block and the maximum pixel compensation ratio for each block; and comparing the calculated (determined) error for each block with a predetermined threshold, and if an error of a first block among the plurality of blocks is less than the threshold, determining the backlight initial diffuser as a target diffuser of the first block.

The determining of the target diffuser for each block may further include if the error of the first block among the plurality of blocks is greater than the threshold, comparing a size of the pixel compensation ratio of the first block with a size of the maximum pixel compensation ratio of the first block; and if the pixel compensation ratio of the first block is greater than the maximum pixel compensation ratio of the first block, additionally obtaining a pixel compensation ratio corresponding to a summation of the backlight initial diffuser and a previous backlight diffuser.

The determining of the target diffuser for each block may further include if the pixel compensation ratio of the first block is less than the maximum pixel compensation ratio of the first block, additionally obtaining a pixel compensation ratio corresponding to a ½ value of the summation of the backlight initial diffuser and the previous backlight diffuser.

In the determining of the target diffuser of the first block, an error between the additionally obtained pixel compensation ratio of the first block and the maximum pixel compensation ratio of the first block may be again compared with the predetermined threshold, and if the error is less than the predetermined threshold, a backlight diffuser corresponding to the additionally obtained pixel compensation ratio of the first block may be determined as the target diffuser of the first block.

The driving of the backlight for each of the plurality of blocks may include obtaining the backlight duty value for each block based on an average pixel value calculated (determined) using pixel values of the pixels for each block; obtaining the backlight diffuser corresponding to the backlight duty value for each block using light profile information corresponding to each of pre-stored backlight duty values; and increasing the backlight duty value for each block by a predefined ratio so that an error between the target diffuser and the backlight diffuser is less than a predetermined threshold.

According to another example aspect of the present disclosure, a display apparatus includes an image input configured to receive an image signal; a display configured to display an image from the received image signal; and a controller configured to distinguish an image to be displayed on the display in a unit of a plurality of blocks, to detect a maximum pixel value of each of the plurality of blocks, to determine a target diffuser usable to compensate for a duty of a backlight based on the detected maximum pixel value for each block, and to control the display to provide the backlight for each of the plurality of blocks based on a backlight duty value compensated for based on the determined target diffuser.

The controller may calculate (determine) a maximum pixel compensation ratio for each block based on the maximum pixel value, and determine the target diffuser for each block with reference to a pixel compensation table representing an association between a pixel compensation ratio and a backlight diffuser.

The maximum pixel compensation ratio for each block may be a ratio of a difference between the maximum pixel value that the pixel for each block has and the detected maximum pixel value for each block, and the detected maximum pixel value for each block.

The controller may obtain the pixel compensation ratio for each block corresponding to a predetermined backlight initial diffuser with reference to the pixel compensation table, calculate (determine) an error between the pixel compensation ratio for each block and the maximum pixel compensation ratio for each block, and compare the calculated (determined) error for each block with a predetermined threshold, and determine the backlight initial diffuser as a target diffuser of the first block if an error of first block among the plurality of blocks is less than the threshold.

The controller may compare a size of the pixel compensation ratio of the first block with a size of the maximum pixel compensation ratio of the first block if the error of the first block among the plurality of blocks is greater than the threshold, and additionally obtain a pixel compensation ratio corresponding to a summation of the backlight initial diffuser and a previous backlight diffuser if the pixel compensation ratio of the first block is greater than the maximum pixel compensation ratio of the first block.

The controller may additionally obtain a pixel compensation ratio corresponding to a ½ value of the summation of the backlight initial diffuser and the previous backlight diffuser if the pixel compensation ratio of the first block is less than the maximum pixel compensation ratio of the first block.

The controller may again compare an error between the additionally obtained pixel compensation ratio of the first block and the maximum pixel compensation ratio of the first block with the predetermined threshold, and determine a backlight diffuser corresponding to the additionally obtained pixel compensation ratio of the first block as the target diffuser of the first block if the error is less than the predetermined threshold.

The controller may obtain the backlight duty value for each block based on an average pixel value calculated (determined) using pixel values of the pixels for each block, obtain the backlight diffuser corresponding to the backlight duty value for each block using light profile information corresponding to each of pre-stored backlight duty values, and increase the backlight duty value for each block by a predefined ratio so that an error between the target diffuser and the backlight diffuser is less than a predetermined threshold.

According to another example aspect of the present disclosure, a recording medium on which a program for executing a method for controlling a driving of a backlight of a display apparatus is stored, wherein the program, when executed by a processor, causes a display apparatus to perform operations comprising: receiving an image; distinguishing the image in a unit of a plurality of blocks to detect a maximum pixel value each of the plurality of blocks; determining a target diffuser usable to compensate for a duty of a backlight based on the detected maximum pixel value for each block; and driving the backlight for each of the plurality of blocks based on a backlight duty value compensated for based on the target diffuser.

According to the various example embodiments of the present disclosure, the display apparatus may address the problem that the gradation overcompensation occurs in the certain block, when the backlight is driven in units of the plurality of blocks using the local dimming method.

BRIEF DESCRIPTION OF THE DRAWINGS

The above and/or other aspects, features and attendant advantages of the present disclosure will be more apparent and readily understood from the following detailed description, taken in conjunction with the accompanying drawings, in which like reference numerals refer to like elements, and wherein.

DETAILED DESCRIPTION

Before describing the present disclosure in greater detail below, a method for demonstrating the present disclosure and drawings will be described.

As terms used in the present disclosure and claims, general terms have been selected by considering functions in various example embodiments of the present disclosure. However, such terms may be varied depending on an intention of those skilled in the art, a legal or technical interpretation, an emergence of a new technology, and the like.

Further, some terms may be terms which are arbitrarily selected. Such terms may be interpreted as meanings defined in the present disclosure, and may also be interpreted based on general contents of the present specification and a typical technical concept in the art unless the terms are not specifically defined.

A term "module", "unit" "part", or the like, in the example embodiment of the present disclosure is a term for referring to the component performing at least one function or operation, and such component may be implemented in hardware or software or a combination of hardware and software. In addition, a plurality of "modules", "units", "parts", or the like may be integrated into at least one module or chip and may be implemented in at least one processor (not illustrated), except for a case in which they need to be each implemented in individual specific hardware.

In addition, in the example embodiments of the present disclosure, it will be understood that when an element is referred to as being "connected to" another element, it can be directly "connected to" the other element or other elements intervening therebetween may be present. In addition, unless explicitly described otherwise, "comprising" any components will be understood to imply the inclusion of other components but not the exclusion of any other components.

Hereinafter, various example embodiments of the present disclosure will be described in greater detail below with reference to the accompanying drawings.

Figure 1:
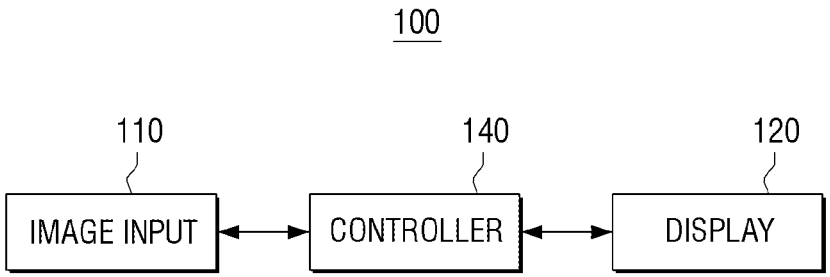
FIG. 1 is a block diagram illustrating an example display apparatus according to an example embodiment of the present disclosure.

FIG. 1 is a block diagram illustrating an example display apparatus according to an example embodiment of the present disclosure.

As illustrated in FIG. 1, the display apparatus 100 may be an image output apparatus such as a smart TV, an LCD monitor, and or like, but is not limited thereto. Such a display apparatus 100 includes an image input (e.g., including image input circuitry) 110, a display 120, and a controller (e.g., including processing circuitry) 140.

The image input 110 may include various circuitry that receives an image signal. Specifically, the image input 110 may receive the image signal from a variety of external devices such as an external storage medium, a broadcasting station, a web server, and the like.

The display 120 displays an image for the image signal received from the image input 110 using a plurality of pixels.

The controller 140 may include various processing circuitry and distinguishes (differentiates or separates) the image for the received image signal into units of a plurality of blocks. According to an example embodiment, the controller 140 may distinguish the image for the received image signal by each region providing the backlight. As described above, when the image for the received image signal is distinguished in units of the plurality of blocks, the controller 140 detects a maximum pixel value for each of the plurality of blocks based on a plurality of pixel values included in each of the plurality of distinguished blocks. Thereafter, the controller 140 determines a target diffuser for compensating for a duty of the backlight based on the pixel value detected for each block.

As used herein, the target diffuser for each block may be a value for preventing and/or reducing a likelihood of a pixel for each block being overcompensated when a reduction rate for the backlight duty value for providing the backlight for each block is increased.

When the target diffuser value is determined, the controller 140 controls the display 120 to drive the backlight for each of the plurality of blocks based on the backlight duty value compensated based on the determined target diffuser.

Accordingly, the display 120 may provide the backlight for each of the plurality of blocks based on the backlight duty value compensated based on the target diffuser determined by the controller 140 to display the image for the received image signal.

Figure 2:
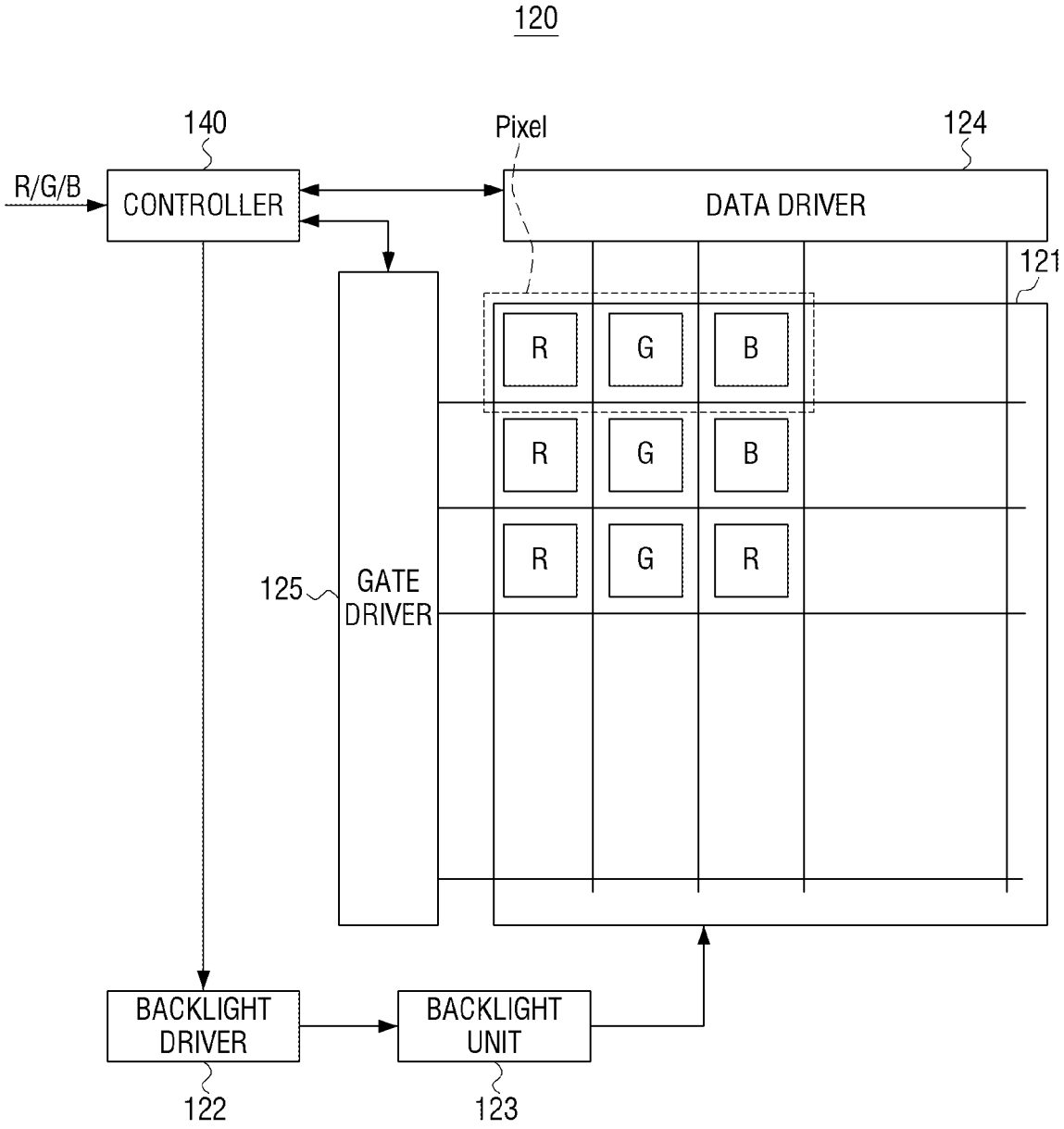
FIG. 2 is a block diagram illustrating an example configuration of a display according to an example embodiment of the present disclosure.

FIG. 2 is a block diagram illustrating an example configuration of the display according to an example embodiment of the present disclosure.

As illustrated in FIG. 2, the display 120 includes a display panel 121, a backlight driver (e.g., including backlight driving circuitry) 122, a backlight unit (e.g., including a light source) 123, a data driver (e.g., including data driving circuitry) 124, and a gate driver (e.g., including gate driving circuitry) 125.

The display panel 121 displays the image based on a plurality of unit pixels including a plurality of sub pixels. Here, the sub pixels have pixels of three colors of red R, green G, and blue B, and the unit pixels include the respective sub pixels having R, G, and B pixels. The plurality of unit pixels including the plurality of sub pixels are arranged in rows and columns, and the display panel 121 may display the image using the plurality of unit pixels arranged in the rows and columns.

The display panel 121 may be implemented as a liquid crystal panel. However, the present disclosure is not limited thereto, and the display panel 121 may be implemented as other types of display panels to which a backlight dimming may be applied.

The backlight driver 122 may include various backlight driving circuitry that drives the backlight unit 123, which includes a light source, to provide the backlight for each of the plurality of distinguished blocks in connection with the image displayed on the display panel 121 based on a control instruction of the controller 140. In particular, the backlight driver 122 may drive the backlight unit 123 to provide the backlight for each of the plurality of blocks based on the backlight duty value compensated based on the target diffuser determined by the controller 140. The backlight unit 123 disposed below the display panel 121 displaying the image provides the backlight to a plurality of display regions which are distinguished in a unit of block, based on a driving instruction of the backlight driver 122. A light source of the backlight unit 123 may include a light source that may include, without limitation, of any one or two or more kinds of a light emitting diode (LED), a hot cathode fluorescent lamp (HCFL), a cold cathode fluorescent lamp (CCFL), and an external electrode fluorescent lamp (EEFL), or the like.

The data driver 124 may include various circuitry that converts R, G, and B data supplied from the controller 140 as digital signals into analog data voltages and supplies the analog data voltages to a plurality of data lines DL1 to DLm. In addition, the gate driver 125 may include various circuitry that sequentially supplies a scan pulse selecting horizontal lines to which the data is to be supplied, to a plurality of gate lines GL1 to GLn. Here, the scan pulse may be alternately supplied to even and odd lines.

Further, the display 120 may further include a timing controller (not shown) that receives an input signal IS, a horizontal synchronization signal Hsync, a vertical synchronization signal Vsync, and a main clock signal MCLK from the outside to generate an image data signal, a scan control signal, a data control signal, and a light emitting control signal, and provides them to the display panel 121, the data driver 124, and the gate driver 125.

Since a detailed configuration of these signals is apparent to those skilled in the art, a further detailed description thereof will be omitted.

Figure 3:
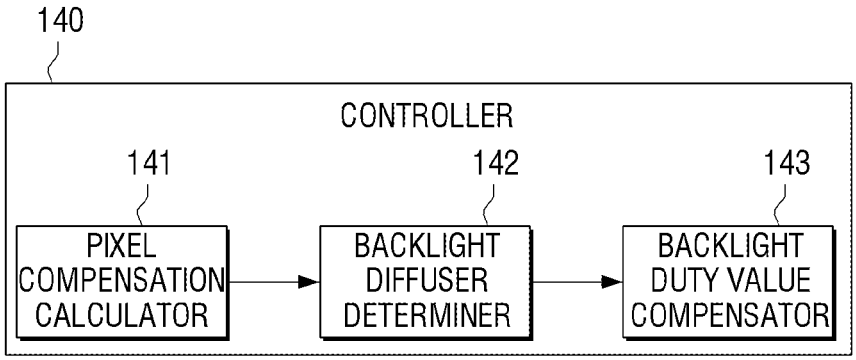
FIG. 3 is a block diagram illustrating an example controller according to an example embodiment of the present disclosure.

FIG. 3 is a block diagram illustrating an example controller according to an example embodiment of the present disclosure.

As described above, the controller 140 may include various processing circuitry and/or program elements that detect the maximum pixel value of each of the plurality of blocks, and determine the target diffuser for compensating the duty of the backlight based on the detected maximum pixel value for each of the blocks. Thereafter, the controller 140 controls the backlight driver 122 to drive the backlight unit 123 providing the backlight for each of the plurality of blocks based on the backlight duty value compensated according to the determined target diffuser.

The controller 140 may include a pixel compensation calculator (e.g., including processing circuitry and/or program elements) 141, a backlight diffuser calculator (e.g., including processing circuitry and/or program elements) 142, and a backlight duty value compensator (e.g., including processing circuitry and/or program elements) 143, as illustrated in FIG. 3.

The pixel compensation calculator 141 may include various processing circuitry and/or program elements and detects the maximum pixel value of each of the plurality of blocks from the pixel values of the pixels included in each of the plurality of blocks, when the plurality of pixels configuring the display image for the received image signal are distinguished in a unit of block. According to an example embodiment, the pixel compensation calculator 141 may distinguish the plurality of pixels configuring an image to be displayed for each region in a unit of block, for each of the regions to which the backlight is provided through the plurality of backlight units 123.

When the maximum pixel value of each of the plurality of blocks is detected, the pixel compensation calculator 141 calculates a maximum pixel compensation ratio for each block based on the maximum pixel value of each of the plurality of blocks.

According to an example embodiment, the pixel compensation calculator 141 may calculate the maximum pixel compensation ratio for each block using mathematical expression 1 below.

$$\alpha=(G\max-B\max)/B\max \quad \text{[Mathematical expression 1]}$$

Here, Gmax is a maximum pixel value that the pixels included in the display panel may have, and Bmax is a maximum pixel value for each block. For example, in a case in which the maximum pixel value of the input image of 8 bits is 255, and the maximum pixel value of a first block is 200, the maximum pixel compensation ratio of the first block may be 27.5%. As such, the pixel compensation calculator 141 may calculate the maximum pixel compensation ratio for each block using mathematical expression 1 above.

The backlight diffuser determiner 142 may include various processing circuitry and/or program elements and determines the target diffuser for each block with reference to a pixel compensation table representing an association between the pixel compensation ratio which is pre-stored in the display apparatus 100 and the backlight diffusion value.

Here, the target diffuser for each block may be a value for preventing (and/or reducing the likelihood that) a pixel for each block from being overcompensated, when a reduction rate for the backlight duty value for providing the backlight for each block is increased.

In a case in which the pixel is compensated by providing the backlight for each block based on the backlight duty value, the target diffuser may be a value for preventing the backlight provided for each block from being overcompensated.

According to an example embodiment, the backlight diffusion value determiner 142 obtains a pixel compensation ratio for each block (hereinafter, referred to as an initial pixel compensation ratio) corresponding to a backlight initial diffusion value with reference to the pixel compensation table. Here, the backlight initial diffusion value may be a predetermined initial set value.

Thereafter, the backlight diffusion value determiner 142 calculates an error between the pre-obtained initial pixel compensation ratio for each block and the maximum pixel compensation ratio for each block calculated by the pixel compensation calculator 141. The backlight diffusion value determiner 142 then compares the error calculated for each block with a predetermined threshold. As a result of the comparison, if an error of the first block among the plurality of blocks is less than the predetermined threshold, the backlight diffusion value determiner 142 determines the backlight initial diffusion value as the target diffuser of the first block.

For example, if the error between the pixel compensation ratio of the first block among the plurality of blocks and the maximum pixel compensation ratio of the first block is a value or less having a predetermined error range, the backlight diffusion value determiner 142 may determine the backlight initial diffusion value, which is the predetermined initial set value, as the target diffuser of the first block.

Here, the value having the error range, which is a value at which a user may not visually recognize a pixel difference, may be changed according to a setting of the user.

Meanwhile, if the error between the initial pixel compensation ratio of the first block and the maximum pixel compensation ratio of the first block is greater than the predetermined threshold, the backlight diffusion value determiner 142 may additionally obtain the pixel compensation ratio of the first block according to the following example embodiment, and if the additionally obtained error between the pixel compensation ratio and the pre-obtained maximum pixel compensation ratio of the first block is smaller than the predetermined first threshold, the backlight diffusion value determiner 142 may determine the target diffuser of the first block.

Such a threshold may be the value having the error range between the pixel compensation ratio and the maxim pixel compensation ratio as described above, but is not limited thereto, and may be changed according to the setting of the user.

Specifically, if the error between the initial pixel compensation ratio of the first block and the maximum pixel compensation ratio of the first block is greater than the predetermined threshold, the backlight diffusion value determiner 142 compares between the initial pixel compensation ratio of the first block and the maximum pixel compensation ratio of the first block. As a result of the comparison, if the initial pixel compensation ratio of the first block is greater than the maximum pixel compensation ratio of the first block, the backlight diffusion value determiner 142 additionally obtains a backlight diffusion value (referred to as a first backlight diffusion value) using mathematical expression 2 below.

$$Bd_{n+1}=Bd_n+Bd_0 \quad \text{[Mathematical expression 2]}$$

Here, $Bd_n$ is an n-th backlight diffusion value, and $Bd_0$ is a backlight initial set value which is initially set. Therefore, a current backlight diffusion value $Bd_{n+1}$ may be determined from a summation of the n-th backlight diffusion value $Bd_n$ and the backlight initial set value $Bd_0$ which is initially set.

However, the present disclosure is not limited thereto, and the current backlight diffusion value $Bd_{n+1}$ may also be determined by a method of increasing the previous backlight diffusion value $Bd_n$ by a predetermined amount.

As described above, if the initial pixel compensation ratio of the first block is greater than the maximum pixel compensation ratio of the first block, the backlight diffusion value determiner 142 determines the first backlight diffusion value for the first block using mathematical expression 2 described above. The backlight diffusion value determiner 142 additionally then obtains a pixel compensation ratio (referred to as a first pixel compensation ratio) corresponding to the first backlight diffusion value which is predetermined with reference to the pixel compensation table.

Meanwhile, if the first pixel compensation ratio of the first block is smaller than the maximum pixel compensation ratio of the first block, the backlight diffusion value determiner 142 additionally obtains a backlight diffusion value (referred to as a second backlight diffusion value) using mathematical expression 3 below.

$$Bd_{n+1}=(Bd_n+Bd_0)/2 \quad \text{[Mathematical expression 3]}$$

Here, $Bd_n$ is an n-th backlight diffusion value, and $Bd_0$ is a backlight initial set value which is initially set. Therefore, a current backlight diffusion value $Bd_{n+1}$ may be determined as an average of the previous backlight diffusion value $Bd_n$ and the backlight initial set value $Bd_0$ which is initially set. If the pixel compensation ratio of the first block is smaller than the maximum pixel compensation ratio of the first block, the backlight diffusion value determiner 142 determines the second backlight diffusion value for the first block using mathematical expression 3 described above, and additionally obtains a second pixel compensation ratio corresponding to the second backlight diffusion value which is predetermined with reference to the pixel compensation table.

If the first or second pixel compensation ratio is additionally obtained according to the example embodiment described above, the backlight diffuser determiner 142 calculates an error between the first or second pixel compensation ratio which is additionally obtained of the first block and the pre-obtained maximum pixel compensation ratio of the first block, and determines whether or not the calculated error is smaller than the predetermined threshold.

As in the example described above, the backlight diffuser determiner 142 determines whether or not an error range between the first or second pixel compensation ratio of the first block and the maximum pixel compensation ratio of the first block is 3% or less.

As a result of the determination, if the error between the first or second pixel compensation ratio which is additionally obtained of the first block and the pre-obtained maximum pixel compensation ratio of the first block is smaller than the predetermined threshold, the backlight diffuser determiner 142 may determine a first backlight diffuser corresponding to the first pixel compensation ratio which is additionally obtained of the first block or a second backlight diffuser corresponding to the second pixel compensation ratio which is additionally obtained of the first block, as the target diffuser of the first block.

Meanwhile, if the error between the first or second pixel compensation ratio which is additionally obtained of the first block and the pre-obtained maximum pixel compensation ratio of the first block is greater than the predetermined threshold, the backlight diffuser determiner 142 repeatedly performs the processing operations according to the example embodiment described above until a value that the error between the pixel compensation ratio of the first block and the pre-obtained maximum pixel compensation ratio of the first block is smaller than the predetermined threshold is deduced.

The backlight duty value compensator 143 may include various processing circuitry and/or program elements and calculates an average pixel value from pixel values for the pixels included in each block, and obtains a backlight duty value for each block based on the calculated average pixel value for each block. Specifically, the backlight duty value compensator 143 may obtain the backlight duty value corresponding to the average pixel value for each block with reference to a gamma table representing an association between the backlight duty values which are pre-stored in the display apparatus 100 and the pixel values.

The backlight duty value compensator 143 then obtains the backlight diffuser corresponding to the backlight duty value which is obtained for each block using light profile information corresponding to each of the backlight duty values which are pre-stored in the display apparatus 100. The backlight duty value compensator 143 then compares an error between the determined target diffuser for each block and the pre-obtained backlight diffuser for each block with the predetermined threshold. As a result of the comparison, if the error between the determined target diffuser for each block and the pre-obtained backlight diffuser for each block is greater than the predetermined threshold, the backlight duty value compensator 143 increases the pre-obtained backlight duty value for each block by a predefined ratio.

The backlight duty value compensator 143 again then compares an error between the backlight diffuser corresponding to the backlight duty value for each block which is increased by a corresponding ratio and the pre-obtained target diffuser for each block with the predetermined threshold. As a result of the comparison, if the error between the backlight diffuser for each block and the target diffuser is smaller than the predetermined threshold, the backlight duty value compensator 143 determines the backlight duty value for each block which is increased by the corresponding ratio as a value for driving the plurality of backlight units 123 for each block.

For example, if the backlight diffuser corresponding to the backlight duty value is obtained from the first block among the plurality of blocks, the backlight duty value compensator 143 calculates an error between the target diffuser which is predetermined in connection with the first block and the pre-obtained backlight diffuser corresponding to the backlight duty value of the first block. The backlight duty value compensator 143 then compares the calculated error with the predetermined threshold, and if the calculated error is smaller than the predetermined threshold, the backlight duty value compensator 143 determines the backlight duty value corresponding to the pre-obtained backlight diffuser as a value for driving the backlight unit 123 of the first block.

Meanwhile, if the calculated error is greater than the predetermined threshold, the backlight duty value compensator 143 increases the backlight duty value to a level corresponding to a predefined ratio.

For example, if a difference between the calculated error and the predetermined threshold is less than 50, the backlight duty value compensator 143 may increase the backlight duty value by adjusting the level in a unit of 5%, and if the difference between the calculated error and the predetermined threshold is 50 or more, the backlight duty value compensator 143 may increase the backlight duty value by adjusting the level in a unit of 10%.

Then, if the backlight diffuser corresponding to the backlight duty value which is increased to the level corresponding to the predefined ratio is additionally obtained, the backlight duty value compensator 143 calculates an error between the target diffuser which is predetermined in connection with the first block and the additionally obtained backlight diffuser.

The backlight duty value compensator 143 then compares the calculated error with the predetermined threshold, and if the calculated error is smaller than the predetermined threshold, the backlight duty value compensator 143 determines the backlight duty value corresponding to the additionally obtained backlight diffuser as the value for driving the backlight unit 123 of the first block.

Meanwhile, if the error between the additionally obtained backlight diffuser and the target diffuser is still greater than the predetermined threshold, the backlight duty value compensator 143 repeatedly performs a series of processes described above until an error which is smaller than the predetermined threshold is obtained.

If the error between an n backlight diffuser obtained by the above-mentioned repetitive performance and the predetermined target diffuser is smaller than the predetermined threshold, the backlight duty value compensator 143 may determine the backlight duty value corresponding to the pre-obtained n backlight diffuser as the value for driving the backlight unit 123 of the first block.

As such, if the backlight duty value for pixel compensation of each block is determined based on the determined target diffuser for each of the plurality of blocks, the controller 140 may control the backlight driver 122 to provide the backlight using the determined backlight duty value for each block. Therefore, the backlight driver 122 may drive the plurality of backlight units 123 for each block to provide the backlight using the determined backlight duty value for each of the plurality of blocks.

Hereinafter, an operation of calculating the target diffuser for each block in the backlight diffuser determiner 142 described above will be more detail.

Figure 4:
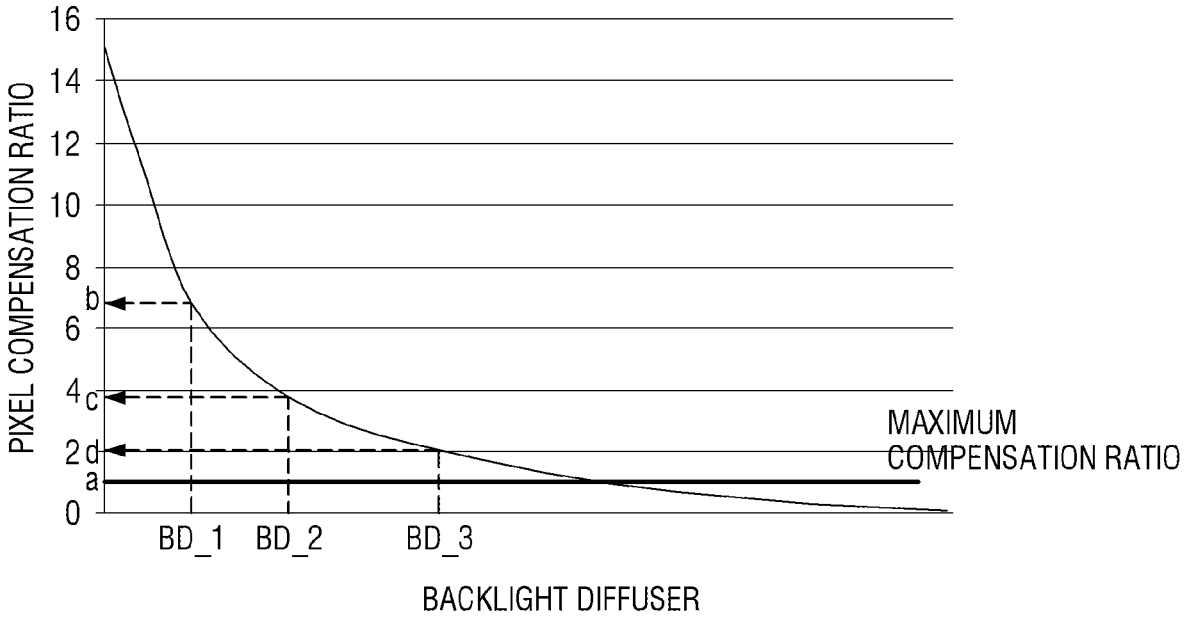
FIG. 4 is a diagram illustrating example determination of a target diffuser for each block according to an example embodiment of the present disclosure.

FIG. 4 is a diagram illustrating example determination of the target diffusion value for each block according to an example embodiment of the present disclosure.

As illustrated in FIG. 4, the backlight diffuser determiner 142 may determine the target diffuser for each block with reference to the pixel compensation table representing an association between the pixel compensation ratio and the backlight diffuser.

The pixel compensation calculator 141 may calculate the maximum pixel compensation ratio of the first block using mathematical expression 1 described above. As illustrated, the maximum pixel compensation ratio having a value of 'a' may be calculated from the first block.

The backlight diffuser determiner 142 obtains a first pixel compensation ratio corresponding to a predetermined backlight initial diffuser $BD_1$ with reference to the pixel compensation table. Here, the first pixel compensation ratio may be a value of 'b'. If the abovementioned first pixel compensation ratio of the first block is obtained, the backlight diffuser determiner 142 calculates an error between the maximum pixel compensation ratio of the first block and the first pixel compensation ratio, and compares the calculated error with the predetermined threshold.

As a result of the comparison, if the calculated error is greater than the predetermined threshold, the backlight diffuser determiner 142 compares the first pixel compensation ratio of the first block with the maximum pixel compensation ratio of the first block. As a result of the comparison, if the first pixel compensation ratio of the first block is greater than the maximum pixel compensation ratio of the first block, the backlight diffuser determiner 142 calculates the first backlight diffuser $BD_2$ using mathematical expression 2 described above, and obtains the second pixel compensation ratio corresponding to the calculated first backlight diffuser $BD_2$. Here, the second pixel compensation ratio may be a value of 'c'.

If the second pixel compensation ratio having the value of 'c' is obtained, the backlight diffuser determiner 142 calculates an error between the second pixel compensation ratio of the first block and the maximum pixel compensation ratio of the first block, and compares the calculated error with the predetermined threshold.

As a result of the comparison, if the calculated error is greater than the predetermined threshold, the backlight diffuser determiner 142 compares the second pixel compensation ratio of the first block with the maximum pixel compensation ratio of the first block. As a result of the comparison, if the second pixel compensation ratio of the first block is greater than the maximum pixel compensation ratio of the first block, the backlight diffuser determiner 142 calculates the second backlight diffuser $BD_3$ using mathematical expression 2 described above, and obtains the third pixel compensation ratio corresponding to the calculated second backlight diffuser $BD_3$. Here, the third pixel compensation ratio may be a value of 'd'.

If the third pixel compensation ratio having the value of is obtained, the backlight diffuser determiner 142 calculates an error between the maximum pixel compensation ratio of the first block with the third pixel compensation ratio of the first block, and compares the calculated error with the predetermined threshold.

As a result of the comparison, if the calculated error is the predetermined threshold or less, the backlight diffuser determiner 142 may determine a second backlight diffuser $BD_3$ corresponding to the third pixel compensation ratio of the first block as the target diffuser of the first block.

If the target diffuser for each block is determined according to the aforementioned example embodiment, the backlight duty value compensator 143 may determine the backlight duty value for pixel compensation for each block based on the determined target diffuser for each block.

As described above, the backlight duty value compensator 143 calculates an average pixel value from pixel values for the pixels included in each block, and obtains a backlight duty value for each block based on the calculated average pixel value for each block. Specifically, the backlight duty value compensator 143 may obtain the backlight duty value corresponding to the average pixel value for each block with reference to a gamma table representing an association between the backlight duty values and the pixel values.

The backlight duty value compensator 143 then obtains the backlight diffuser corresponding to the backlight duty value which is obtained for each block using light profile information corresponding to each of the backlight duty values which are pre-stored. The backlight duty value compensator 143 then compares an error between the determined target diffuser for each block and the pre-obtained backlight diffuser for each block with the predetermined threshold. As a result of the comparison, if the error between the determined target diffuser for each block and the pre-obtained backlight diffuser for each block is greater than the predetermined threshold, the backlight duty value compensator 143 increases the pre-obtained backlight duty value for each block by a predefined ratio.

The backlight duty value compensator 143 again then compares an error between the backlight diffuser corresponding to the backlight duty value for each block which is increased by a corresponding ratio and the pre-obtained target diffuser for each block with the predetermined threshold. As a result of the comparison, if the error between the backlight diffuser for each block and the target diffuser is smaller than the predetermined threshold, the backlight duty value compensator 143 determines the backlight duty value for each block which is increased by the corresponding ratio as a value for driving the backlight unit 123 for each block.

FIGS. 5A, 5B, 5C and 5D are diagrams illustrating an example adjustment of a light profile for each block using a light profile based on the target diffusion value according to an example embodiment of the present disclosure.

Figure 5A:
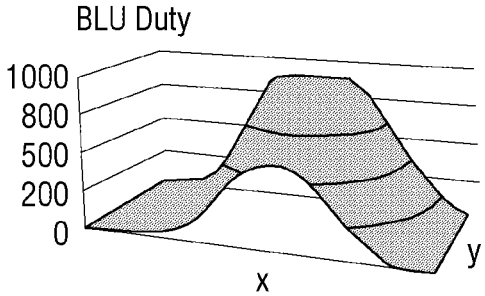
FIGS. 5A, 5B, 5C and 5D are diagrams illustrating example adjustment of a light profile for each block using a light profile based on the target diffuser according to an example embodiment of the present disclosure.

As illustrated in FIG. 5A, the light profile information representing a change of the backlight may be obtained based on the target diffuser of the first block among the plurality of blocks.

Therefore, the backlight duty value compensator 143 adjusts the backlight duty value of the first block so that a light profile similar to the corresponding light profile may be generated based on the light profile information based on the target diffuser of the first block illustrated in FIG. 5A.

Specifically, the backlight duty value compensator 143 calculates the average pixel value from the pixel values of the pixels included in the first block. The backlight duty value compensator 143 then obtains the backlight duty value corresponding to the average pixel value of the first block with reference to a gamma table representing an association between the backlight duty values and the pixel values.

Then, the backlight duty value compensator 143 obtains the light profile corresponding to the pre-obtained backlight duty value with reference to the light profile information which is pre-stored, and calculates an error between the backlight diffuser for the obtained light profile and the target diffuser of the first block. Then, if the calculated error is greater than the predetermined threshold, the backlight duty value compensator 143 increases the backlight duty value of the first block by the predefined ratio until the corresponding error is smaller than the predetermined threshold.

Figure 5B:
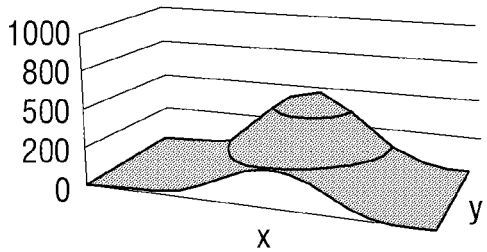
Figure 5C:
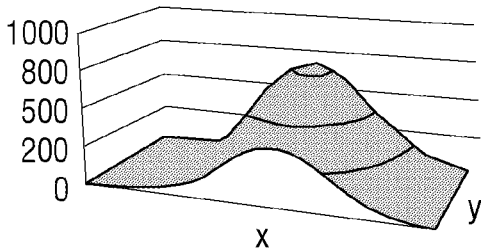
Figure 5D:
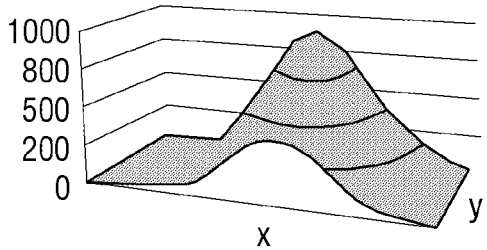

If the backlight duty value of the first block is increased gradually by a predetermined ratio as described above, the light profile of the first block is changed in the order illustrated in FIGS. 5B, 5C, and 5D. Meanwhile, if an error between the backlight diffuser of the first block associated with the light profile illustrated in FIG. 5D and the target diffuser of the first block is smaller than the predetermined threshold, the backlight duty value compensator 143 determines the backlight duty value which is set in connection with the light profile illustrated in FIG. 5D as the value for driving the backlight unit 123 of the first block.

Figure 6:
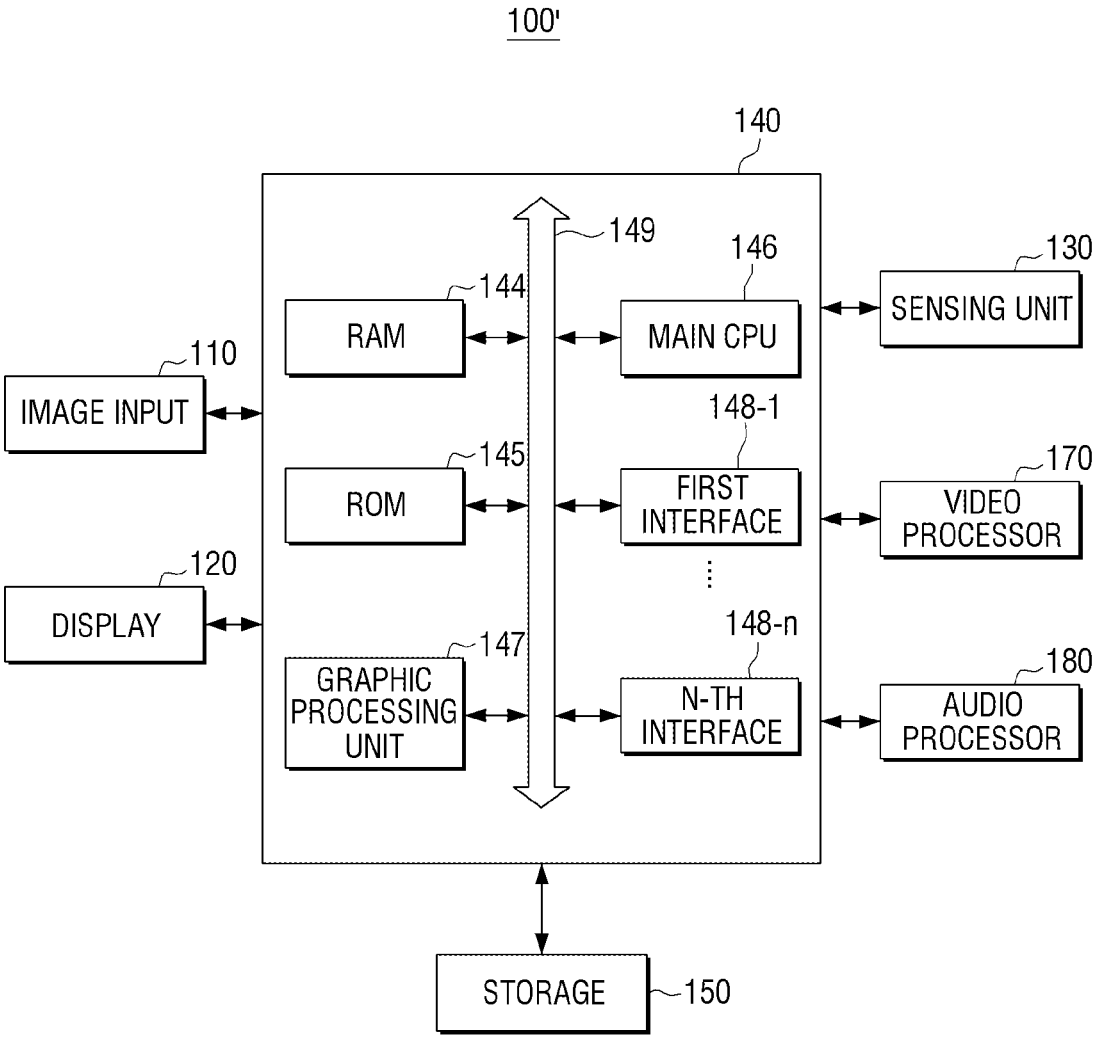
FIG. 6 is a block diagram illustrating an example display apparatus according to the example embodiment of the present disclosure.

FIG. 6 is a block diagram illustrating an example display apparatus according to the example embodiment of the present disclosure.

As illustrated in FIG. 6, the display apparatus 100 includes the image input (e.g., including input circuitry) 110, the display 120, a sensing unit (e.g., including at least one sensor and/or sensing circuitry) 130, a processor (e.g., including processing circuitry) 140, a storage 150, a video processor (e.g., including video processing circuitry) 170, and an audio processor (e.g., including audio processing circuitry) 180.

A detailed description of the components illustrated in FIG. 6 which are overlapped with those illustrated in FIG. 1 will not be repeated here.

The processor 140 may include various processing circuitry and control an overall operation of the display apparatus 100.

Specifically, the controller 140 includes a random access memory (RAM) 144, a read only memory (ROM) 145, a main central processing unit (CPU) 146, a graphic processing unit 147, first to n-th interfaces 148-1 to **148-*n*, and a bus 149**.

The RAM 144, the ROM 145, the main CPU 146, the graphic processing unit 147, the first to n-th interfaces 148-1 to **148-*n*, and the like may be connected to each other through the bus 149**.

The first to n-th interfaces 148-1 to **148-*n*** are connected to the variety of components described above. One of the interfaces may be a network interface connected to an external device via a network.

The main CPU 146 accesses the storage 150 and performs a booting operation using an operating system (O/S) stored in the storage 150. In addition, the main CPU 146 performs various operations using a variety of programs, contents, data, and the like stored in the storage 150.

The ROM 145 stores a set of instructions for booting a system, and the like. When a turn-on instruction is input to the main CPU 146 to supply power to the main CPU 146, the main CPU 146 copies the 0/S stored in the storage 150 in the RAM 144 according to the instructions stored in the ROM 145, and executes the 0/S to boot the system. When the booting of the system is completed, the main CPU 146 copies a variety of application programs stored in the storage 150 in the RAM 144, and executes the application programs copied in the RAM 144 to perform a variety of operations.

The graphic processing unit 147 generates a screen including various objects such as an icon, an image, a text, and the like, for example, a screen including a pointing object, using a calculator (not shown) and a renderer (not shown). The calculator (not shown) calculates attribute values such as coordinate values, shapes, sizes, colors, and the like in which the respective objects are to be displayed according to a layout of the screen based on the received control instruction. The renderer (not shown) generates the screen of various layouts including the objects based on the attribute values calculated by the calculator (not shown).

Meanwhile, the operation of the processor 140 described above may be performed by the program stored in the storage 150 as illustrated in FIG. 6.

The storage 150 stores an operating system (O/S) software module for driving the display apparatus 100 and various data such as a variety of multimedia contents.

In particular, the storage 150 may store programs of the pixel compensation calculation module, the backlight diffuser determining module, and the backlight duty value compensation module described above.

In addition, the storage 150 may store various gamma tables and pixel compensation tables. Therefore, the processor 140 may determine the target diffuser for applying the backlight duty for each of the plurality of blocks with reference to the gamma tables and the pixel compensation tables which are pre-stored in the storage 150 and the backlight duty value for pixel compensation for each block based on the target diffuser.

The sensing unit 130 is a component sensing a surrounding environment. The sensing unit 130 may include various sensors and/or sensing circuitry to sense one or more of various characteristics such as illumination, intensity, color, an incident direction, an incident area, a distribution degree, and the like of light. According to an example embodiment, the sensing unit 130 may be an illumination sensor, a temperature sensing sensor, a light amount sensing layer, a camera, or the like, but is not limited thereto.

The video processor 170 is a component performing a processing for video data. The video processor 170 may include various video processing circuitry to perform various image processes such as decoding, scaling, noise filtration, frame rate conversion, resolution conversion, etc., for the video data.

The audio processor 180 is a component performing a processing for audio data. The audio processor 180 may include various audio processing circuitry to perform various processes such as decoding, amplification, noise filtration, etc., for the audio data.

Hereinafter, a method for controlling a display apparatus according to an example embodiment of the present disclosure will be described in detail.

Figure 7:
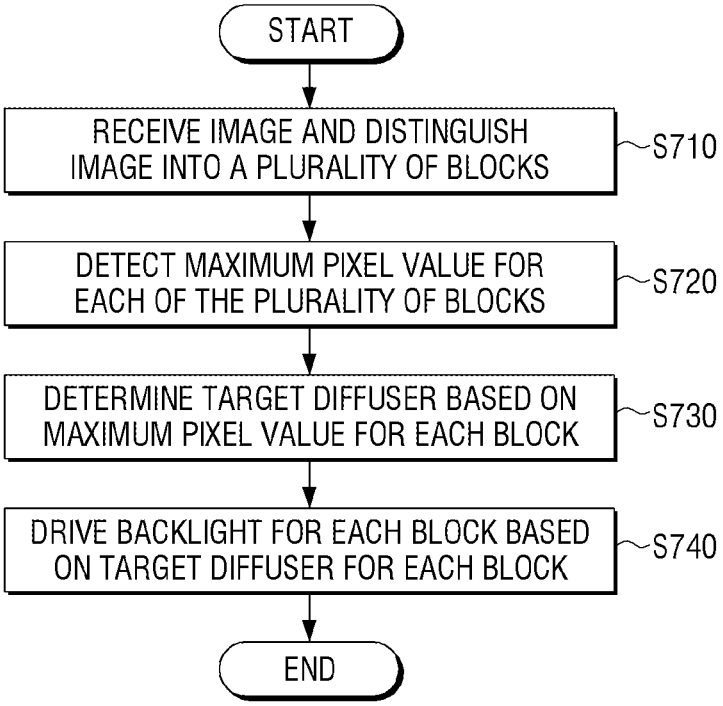
FIG. 7 is a flowchart illustrating an example method for driving a display apparatus according to an example embodiment of the present disclosure.

FIG. 7 is a flowchart illustrating an example method for driving a display apparatus according to an example embodiment of the present disclosure.

As illustrated in FIG. 7, if an image is received, the display apparatus 100 distinguishes the received image in a unit of a plurality of blocks (S710). The display apparatus 100 then detects a maximum pixel value of each of the plurality of blocks (S720). That is, the display apparatus 100 may detect the maximum pixel value for each of the plurality of blocks based on a plurality of pixel values included in each of the plurality of blocks distinguished from the received image.

The display apparatus 100 determines a target diffuser for compensating for a duty of a backlight based on the maximum pixel value detected for each block (S730).

Here, the target diffuser for each block may be a value for preventing (and/or reducing a likelihood of) a pixel for each block from being overcompensated when a reduction rate for the backlight duty value for providing the backlight for each block is increased.

If the aforementioned target diffuser for each block is determined, the display apparatus 100 drives a backlight unit for each of the plurality of blocks to provide the backlight based on the backlight duty value compensated based on each target diffuser determined for each block (S740).

Figure 8:
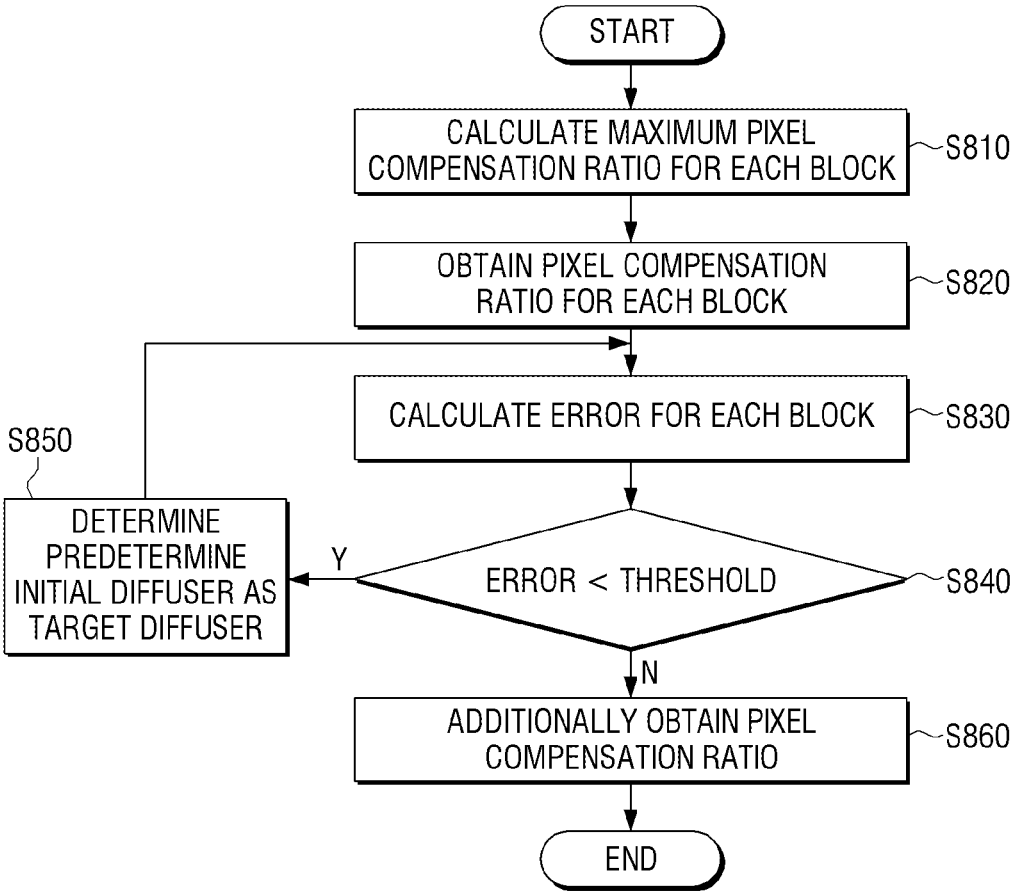
FIG. 8 is a flowchart illustrating an example of determining a target diffuser for compensating for a duty of a backlight for each block in the display apparatus according to an example embodiment of the present disclosure.

FIG. 8 is a flowchart illustrating an example of determining a target diffuser for compensating for a duty of a backlight for each block in the display apparatus according to an example embodiment of the present disclosure.

As illustrated in FIG. 8, if the plurality of pixels configuring the received image are distinguished in a unit of block and the maximum pixel value for each of the plurality of distinguished blocks is detected, the display apparatus 100 calculates a maximum pixel compensation ratio for each block based on the maximum pixel value for each of the plurality of blocks (S810). According to an example embodiment, the display apparatus 100 may calculate the maximum pixel compensation ratio for each block using mathematical expression 1 described above.

If the maximum pixel compensation ratio for each block is calculated, the display apparatus 100 obtains a pixel compensation ratio for each block corresponding to a predetermined backlight initial diffuser with reference to a pixel compensation table representing an association between the pixel compensation ratio and backlight diffuser (S820).

Then, the display apparatus 100 calculates an error between the pre-obtained pixel compensation ratio for each block and the pre-calculated maximum pixel compensation ratio for each block, and compares the calculated error for each block with a predetermined threshold (S830, S840).

As a result of the comparison, if an error of the first block among the plurality of blocks is less than the predetermined threshold, the display apparatus 100 determines the predetermined backlight initial diffuser as the target diffuser of the first block (S850).

Meanwhile, if the error between the pixel compensation ratio of the first block and the maximum pixel compensation ratio of the first block is greater than the predetermined threshold, the display apparatus 100 additionally obtains the pixel compensation ratio for the first block (S860).

A method for additionally obtaining the pixel compensation ratio for the first block as described above will be described in more detail with reference to FIG. 9.

Figure 9:
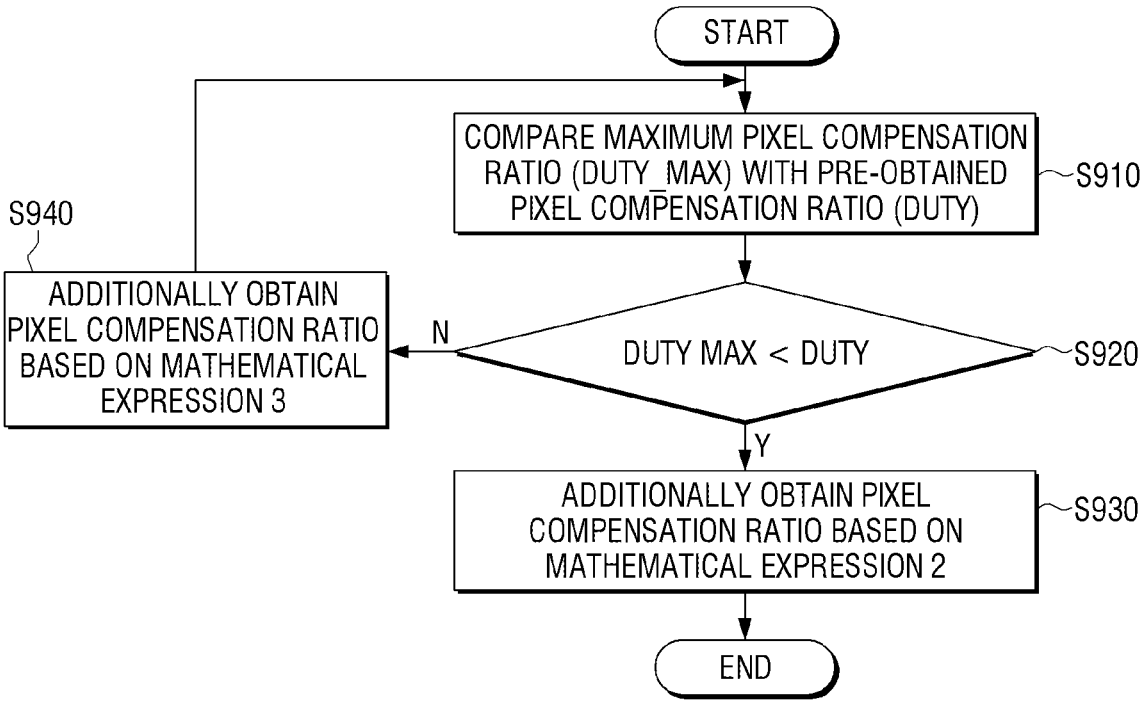
FIG. 9 is a flowchart illustrating an example method for additionally obtaining a pixel compensation ratio to determine the target diffuser for each block in the display apparatus according to an example embodiment of the present disclosure.

FIG. 9 is a flowchart illustrating an example method for additionally obtaining a pixel compensation ratio to determine the target diffusion value for each block in the display apparatus according to an example embodiment of the present disclosure.

As described above, if the error between the pixel compensation ratio of the first block among the plurality of blocks and the maximum pixel compensation ratio of the first block is greater than the predetermined threshold, the display apparatus 100 compares the size of the pixel compensation ratio (Duty) of the first block with the size of the maximum pixel compensation ratio (Duty_max) of the first block (S910, S920).

As a result of the comparison, if it is determined that the pixel compensation ratio of the first block is greater than the maximum pixel compensation ratio of the first block, the display apparatus 100 additionally obtains the pixel compensation ratio of the first block using mathematical expression 2 described above (S930).

Meanwhile, if it is determined that the pixel compensation ratio of the first block is less than the maximum pixel compensation ratio of the first block, the display apparatus 100 additionally obtains the pixel compensation ratio of the first block using mathematical expression 3 described above (S940).

As such, if the pixel compensation ratio of the first block is additionally obtained, the display apparatus 100 again performs S830 to S860 of FIG. 8 described above.

That is, if the pixel compensation ratio of the first block is additionally obtained, the display apparatus 100 calculates an error between the additionally obtained pixel compensation ratio and the maximum pixel compensation ratio of the first block, and compares the calculated error with the predetermined threshold.

As a result of the comparison, if the calculated error is smaller than the predetermined threshold, the display apparatus 100 may determine a backlight diffuser corresponding to the additionally obtained pixel compensation ratio of the first block as the target diffuser of the first block.

Meanwhile, if the error between the additionally obtained pixel compensation ratio of the first block and the maximum pixel compensation ratio of the first block is greater than the predetermined threshold, the display apparatus 100 repeatedly performs the operations described above until a value that the error between the pixel compensation ratio of the first block and the pre-obtained maximum pixel compensation ratio of the first block is smaller than the predetermined threshold is deduced.

Meanwhile, the display apparatus 100 may determine the target diffusers of the remaining blocks other than the first block described above among the plurality of blocks by performing the operations of FIGS. 8 and 9 described above.

If the target diffuser for each of the plurality of blocks is determined by performing a series of operations described above, the display apparatus 100 may determine the backlight duty value for pixel compensation for each block based on the determined target diffuser for each block.

Figure 10:
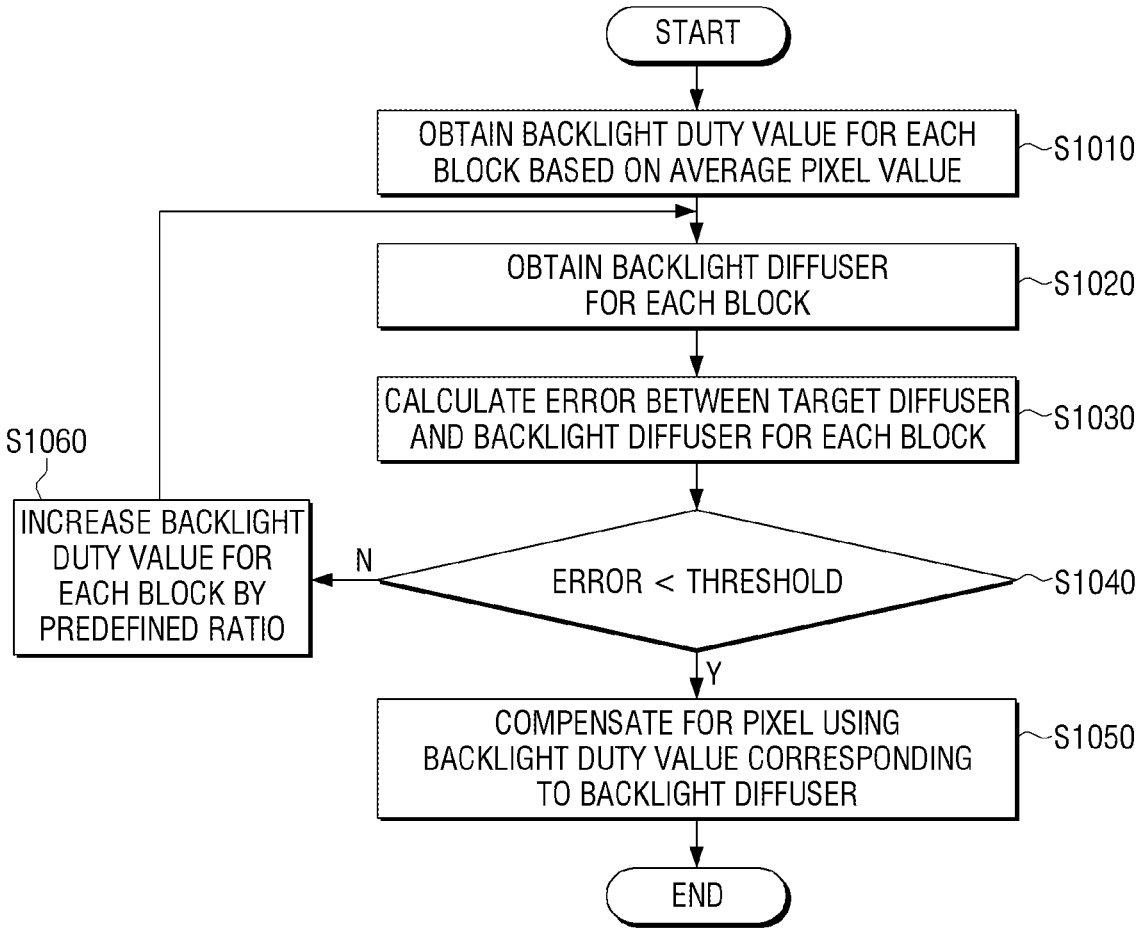
FIG. 10 is a flowchart illustrating an example of determining a backlight duty value for pixel compensation for each block in the display apparatus according to an example embodiment of the present disclosure.

FIG. 10 is a flowchart illustrating an example of determining a backlight duty value for pixel compensation for each block in the display apparatus according to an example embodiment of the present disclosure.

As illustrated in FIG. 10, if the target diffuser for each block is determined, the display apparatus 100 calculates an average pixel value for each block from the pixel values for the pixels included in each block. The display apparatus 100 obtains the backlight duty value for each block based on the calculated average pixel value for each block (S1010).

Specifically, the display apparatus 100 may obtain the backlight duty value corresponding to the average pixel value for each block with reference to a gamma table representing an association between the backlight duty values and the pixel values.

As such, if the backlight duty value corresponding to the average pixel value for each block is obtained, the display apparatus 100 obtains the backlight diffuser corresponding to the pre-obtained backlight duty value for each block using light profile information corresponding to each of the pre-stored backlight duty values (S1020).

The display apparatus 100 calculates an error between the determined target diffuser for each block and the pre-obtained backlight diffuser for each block (S1030). The display apparatus 100 then compares the calculated error for each block with the predetermined threshold (S1040).

As a result of the comparison, if the error between the determined target diffuser for each block and the pre-obtained backlight diffuser for each block is less than the predetermined threshold, the display apparatus 100 determines the duty value for each block corresponding to the backlight diffuser for each block as a value for pixel compensation for each block (S1050).

Meanwhile, if the error between the determined target diffuser for each block and the pre-obtained backlight diffuser for each block is greater than the predetermined threshold, the display apparatus 100 increases the pre-obtained backlight duty value for each block by a predefined ratio (S1060).

The display apparatus 100 again performs S1020 to S1040 described above. That is, if the backlight diffuser corresponding to the backlight duty value for each block which is increased by the predefined ratio is obtained, the display apparatus 100 calculates an error between the obtained backlight diffuser for each block and the pre-obtained target diffuser for each block. The display apparatus 100 then compares the calculated error for each block with the predetermined threshold.

As a result of the comparison, if the calculated error for each block is smaller than the predetermined threshold, the display apparatus 100 determines the backlight duty value for each block which is increased by the corresponding ratio as a value for driving the backlight for each block.

Meanwhile, if it is determined that the calculated error for each block is greater than the predetermined threshold, the display apparatus 100 again performs the aforementioned operations until an error value smaller than the predetermined threshold is obtained.

As such, if the backlight duty value for pixel compensation of each block is determined based on the determined target diffuser for each of the plurality of blocks, the display apparatus 100 may provide the backlight for each block using the determined backlight duty value for each block.

As such, in a case in which the backlight for each block is provided in the local dimming mode, the display apparatus 100 according to an example embodiment of the present disclosure determines the target diffuser using the maximum pixel value for each block, and determines the backlight diffuser corresponding to the backlight duty value associated with the average pixel value for each block. The display apparatus 100 according to an example embodiment of the present disclosure then determines the backlight duty value for providing the backlight for each block by adjusting the backlight duty value for each block so that the error between the predetermined target diffuser for each block and the backlight diffuser is smaller than the predetermined threshold.

Therefore, according to the present disclosure, it is possible to address a problem that gradation overcompensation occurs in a region of a certain block, when the backlight for each of the plurality of blocks is provided using the local dimming mode.

Meanwhile, the method for controlling the display apparatus 100 as described above may be implemented in at least one execution program, and such an execution program may be stored in a non-transitory computer readable medium.

The non-transitory computer readable medium means a machine readable medium that stores the data. Specifically, the aforementioned programs may be stored in various types of recording media which are readable in a terminal, such as a random access memory (RAM), a flash memory, a read only memory (ROM), an erasable programmable ROM (EPROM), an electronically erasable and programmable ROM (EEPROM), a register, a hard disk, a removable disk, a memory card, a universal serial bus (USB) memory, a compact disk (CD) ROM, and the like, but is not limited thereto.

Hereinabove, the present disclosure has been described with reference to the example embodiments thereof.

Although various example embodiments of the present disclosure have been disclosed for illustrative purposes, those skilled in the art will appreciate that various modifications, additions and substitutions are possible, without departing from the scope and spirit of the disclosure as disclosed in the accompanying claims. Accordingly, such modifications, additions and substitutions should also be understood to fall within the scope of the present disclosure.

What is claimed is:

1. A method for controlling a display apparatus, the method comprising:

receiving an image;

distinguishing the image into a plurality of blocks to detect a maximum pixel value of each of the plurality of blocks among pixel values of a plurality of pixels included in each of the plurality of blocks;

determining a target diffuser value usable for compensating for a duty value of a backlight based on the detected maximum pixel value for each block; and driving the backlight for each of the plurality of blocks based on the backlight duty value compensated based on the target diffuser value, wherein the determining of the target diffuser value includes:

determining a maximum pixel compensation ratio for each block based on the maximum pixel value;

obtaining the pixel compensation ratio for each block corresponding to a predetermined backlight initial diffuser value based on a pixel compensation ratio and a backlight diffuser value;

determining an error between the pixel compensation ratio for each block and the maximum pixel compensation ratio for each block; and determining the target diffuser value for each block based on the determined error for each block and a predetermined threshold.

2. The method as claimed in claim 1, wherein the maximum pixel compensation ratio for each block comprises a ratio of: a difference between the maximum pixel value that a plurality of pixels included in a display panel of the display apparatus has and the detected maximum pixel value for each block, and the detected maximum pixel value for each block.

3. The method as claimed in claim 1, wherein said obtaining the pixel compensation ratio for each block comprises obtaining the pixel compensation ratio for each block corresponding to a predetermined backlight initial diffuser value based on a pixel compensation table representing an association between a pixel compensation ratio and a backlight diffuser value; and wherein the determining the target diffuser value for each block comprises:

comparing the determined error for each block with the predetermined threshold, and based on an error of a first block among the plurality of blocks being less than the predetermined threshold, determining the backlight initial diffuser value as a target diffuser value of the first block.

4. The method as claimed in claim 3, wherein the determining of the target diffuser value for each block further includes:

comparing a size of the pixel compensation ratio of the first block with a size of the maximum pixel compensation ratio of the first block if the error of the first block among the plurality of blocks is greater than the threshold; and additionally obtaining a pixel compensation ratio corresponding to a sum of the backlight initial diffuser value and a previous backlight diffuser value if the pixel compensation ratio of the first block is greater than the maximum pixel compensation ratio of the first block.

5. The method as claimed in claim 4, wherein the determining of the target diffuser value for each block further includes:

additionally obtaining a pixel compensation ratio corresponding to a ½ value of the sum of the backlight initial diffuser value and the previous backlight diffuser value if the pixel compensation ratio of the first block is less than the maximum pixel compensation ratio of the first block.

6. The method as claimed in claim 5, wherein in the determining of the target diffuser value of the first block, an error between the additionally obtained pixel compensation ratio of the first block and the maximum pixel compensation ratio of the first block is again compared with the predetermined threshold, and a backlight diffuser value corresponding to the additionally obtained pixel compensation ratio of the first block is determined as the target diffuser value of the first block if the error is smaller than the predetermined threshold.

7. The method as claimed in claim 1, wherein the driving of the backlight for each of the plurality of blocks includes:

obtaining the backlight duty value for each block based on an average pixel value determined using pixel values of the plurality of pixels included in each of the plurality of blocks;

obtaining the backlight diffuser value corresponding to the backlight duty value for each block using light profile information corresponding to each of pre-stored backlight duty values; and increasing the backlight duty value for each block by a predefined ratio so that an error between the target diffuser value and the backlight diffuser value is less than a predetermined threshold.

8. A display apparatus comprising:

an image input comprising input circuitry configured to receive an image signal;

a display configured to display an image from the received image signal; and a controller configured to distinguish an image to be displayed on the display into a plurality of blocks, to detect a maximum pixel value of each of the plurality of blocks among pixel values of a plurality of pixels included in each of the plurality of blocks, to determine a target diffuser value usable for compensating for a duty value of a backlight based on the detected maximum pixel value for each block, and to control the display to provide the backlight for each of the plurality of blocks based on the backlight duty value compensated based on the determined target diffuser value, wherein the controller is configured to:

determine a maximum pixel compensation ratio for each block based on the maximum pixel value;

obtain the pixel compensation ratio for each block corresponding to a predetermined backlight initial diffuser value based on a pixel compensation ratio and a backlight diffuser value;

determine an error between the pixel compensation ratio for each block and the maximum pixel compensation ratio for each block; and determine the target diffuser value for each block based on the determined error for each block and a predetermined threshold.

9. The display apparatus as claimed in claim 8, wherein the maximum pixel compensation ratio for each block is a ratio of: a difference between the maximum pixel value that a plurality of pixels included in the display has and the detected maximum pixel value for each block, and the detected maximum pixel value for each block.

10. The display apparatus as claimed in claim 8, wherein the controller is configured to obtain the pixel compensation ratio for each block corresponding to a predetermined backlight initial diffuser value with reference to a pixel compensation table representing an association between a pixel compensation ratio and a backlight diffuser value, and to compare the determined error for each block with the predetermined threshold, and to determine the backlight initial diffuser value as a target diffuser value of the first block based on an error of first block among the plurality of blocks being less than the threshold.

11. The display apparatus as claimed in claim 10, wherein the controller is configured to compare a size of the pixel compensation ratio of the first block with a size of the maximum pixel compensation ratio of the first block if the error of the first block among the plurality of blocks is greater than the predetermined threshold, and to additionally obtain a pixel compensation ratio corresponding to a sum of the backlight initial diffuser value and a previous backlight diffuser value if the pixel compensation ratio of the first block is greater than the maximum pixel compensation ratio of the first block.

12. The display apparatus as claimed in claim 11, wherein the controller is configured to additionally obtain a pixel compensation ratio corresponding to a ½ value of the sum of the backlight initial diffuser value and the previous backlight diffuser value if the pixel compensation ratio of the first block is less than the maximum pixel compensation ratio of the first block.

13. The display apparatus as claimed in claim 12, wherein the controller is configured to again compare an error between the additionally obtained pixel compensation ratio of the first block and the maximum pixel compensation ratio of the first block with the predetermined threshold, and to determine a backlight diffuser value corresponding to the additionally obtained pixel compensation ratio of the first block as the target diffuser value of the first block if the error is less than the predetermined threshold.

14. The display apparatus as claimed in claim 8, wherein the controller is configured to obtain the backlight duty value for each block based on an average pixel value determined using pixel values of the plurality of pixels included in each of the plurality of blocks, to obtain the backlight diffuser value corresponding to the backlight duty value for each block using light profile information corresponding to each of pre-stored backlight duty values, and to increase the backlight duty value for each block by a predefined ratio so that an error between the target diffuser value and the backlight diffuser value is less than a predetermined threshold.

15. A non-transitory recording medium on which a program for executing a method for controlling a driving of a backlight of a display apparatus is stored, the program, when executed by a processor, causes the processor to perform operations comprising:

receiving an image;

distinguishing the image into a plurality of blocks to detect a maximum pixel value each of the plurality of blocks among pixel values of a plurality of pixels included in each of the plurality of blocks;

determining a target diffuser value usable for compensating for a duty value of a backlight based on the detected maximum pixel value for each block;

driving the backlight for each of the plurality of blocks based on the backlight duty value compensated based on the target diffuser value, determining a maximum pixel compensation ratio for each block based on the maximum pixel value;

obtaining the pixel compensation ratio for each block corresponding to a predetermined backlight initial diffuser value based on a pixel compensation ratio and a backlight diffuser value;

determining an error between the pixel compensation ratio for each block and the maximum pixel compensation ratio for each block; and determining the target diffuser value for each block based on the determined error for each block and a predetermined threshold.

* * * * *